US007017852B2

(12) United States Patent
Perrigo et al.

(10) Patent No.: US 7,017,852 B2
(45) Date of Patent: Mar. 28, 2006

(54) MULTIPLE FIXED-POSITION FILM CENTERWINDER AND METHOD FOR WINDING WEB MATERIAL

(75) Inventors: Michael C. Perrigo, Staten Island, NY (US); Jei Luh, Kearny, NJ (US)

(73) Assignee: Davis-Standard Corporation, Pawcatuck, CT (US)

( * ) Notice: Subject to any disclaimer, the term of this patent is extended or adjusted under 35 U.S.C. 154(b) by 0 days.

(21) Appl. No.: 10/816,426

(22) Filed: Apr. 1, 2004

(65) Prior Publication Data

US 2005/0040279 A1 Feb. 24, 2005

Related U.S. Application Data

(63) Continuation of application No. 10/125,872, filed on Apr. 18, 2002, now abandoned.

(60) Provisional application No. 60/284,944, filed on Apr. 20, 2001.

(51) Int. Cl.
*B65H 35/00* (2006.01)

(52) U.S. Cl. ..... 242/523.1; 242/598.2; 242/533.2

(58) Field of Classification Search ..... 242/531.1, 242/523.1, 533.2, 598.2, 547
See application file for complete search history.

(56) References Cited

U.S. PATENT DOCUMENTS

| | | | | | |
|---|---|---|---|---|---|
| 3,752,412 | A | * | 8/1973 | Byrt | 242/523.1 |
| 3,783,750 | A | * | 1/1974 | Heimeijer | 493/196 |
| 3,872,650 | A | * | 3/1975 | Vickers | 53/207 |
| 4,360,170 | A | * | 11/1982 | Kuklies et al. | 242/527 |
| 4,489,900 | A | * | 12/1984 | Morizzo | 242/531.1 |
| 5,653,400 | A | * | 8/1997 | Narita et al. | 242/530.4 |
| 5,891,010 | A | * | 4/1999 | Kobben et al. | 493/478 |

* cited by examiner

*Primary Examiner*—Kathy Matecki
*Assistant Examiner*—Sang Kim
(74) *Attorney, Agent, or Firm*—Levy & Grandinetti

(57) ABSTRACT

The invention is a centerwinder for receiving and winding web material sequentially on one of at least two fixed shafts. The two or more shafts are desirably positioned vertically to one another in a stationary structure and eliminate the need for a powered turret assembly. A lay-on roll assembly can be used that pivots in and out as well as up and down for serving the respective shaft locations. A cylinder linkage provides the same or constant force against the winding roll on either the upper or the lower shaft. Transfer rolls in desirable embodiments are automatically pivoted into the proper position for a fully automatic transfer or to assist the operator during a manual cut and transfer.

6 Claims, 10 Drawing Sheets

MULTIPLE FIXED-POSITION FILM CENTERWINDER AND METHOD FOR WINDING WEB MATERIAL

This application is a continuation of U.S. application Ser. No. 10/125,872, filed Apr. 18, 2002, now abandoned, which claims priority to U.S. Provisional Application No. 60/284,944, which was filed on Apr. 20, 2001.

BACKGROUND OF THE INVENTION

1. Field of the Invention

The invention relates to a web centerwinder for receiving and winding a web material and its method for winding. Specifically, the invention relates to a web central winder and method for receiving and winding web material sequentially on one of at least two fixed shafts.

2. Brief Description of the Background Art

"Centerwinding" is a term used in the film, foil, or paper industries to describe the process of receiving a web material as it is produced and turning the web material on a core or shaft in order to wind a roll of the web material. Centerwinding winds a roll by driving the roll from the center as opposed to surface winding. A web of film, foil, or paper is typically wound on a cardboard or fiber core that is secured on a mandrel shaft or from end supports. The roll of web material is removed and shipped to an end user.

A centerwinder can use a single core, shaft, or spindle, supported in a frame and driven by a motor. Commonly, multiple shafts are provided, keeping one in standby ready to accept the constantly flowing web as the other core, shaft, or spindle completes winding a full roll of web material.

An example occurs in the plastics industry where a polymer film is generated by blown film production methods and wound on a cardboard or fibrous core. Rolls of film can be produced wherein, for example, 1,500 linear feet or more of film is wound into a single roll of film. The roll of film can then be shipped to a plastic bag manufacturer. The plastic bag manufacturer can subsequently print the film and produce bags from the film.

Increased operating speeds of continuous web systems led the industry to adopt turret-type centerwinders. Turret-type centerwinders commonly incorporate two or more shafts mounted to a rotatable turret assembly. The turret has a winding position and an unloading position. The turret revolves to place a core into the feed of a web material while simultaneously positioning the full roll in a position for unloading or removal from the turret.

Turret-type centerwinders include a lay-on roll to smooth the film and meter or remove air between layers of film. Such centerwinders have additional mechanisms to automate the web transfer from a full roll to a new core. Shortcomings of these "turret winders" include (1) extra equipment complexity and higher equipment costs, (2) the winding shafts located on a rotatable turret impede the transfer of the web and roll stability, and (3) inherent difficulties in unloading and recording a shaft located on a rotatable turret.

U.S. Pat. No. 2,256,082 to Feurt discloses a paper converting machine. This early example of a winding device was concerned with minimizing the loss of time due to breaking of "thin stock" or web material. The invention of this patent required control of the stopping and starting of the machine for each individual roll so that no unwanted breakages in the web material occur.

U.S. Pat. No. 4,678,133 to Suzuki discloses an automatic cutting and winding apparatus for a web-like material such as a film. This patent discloses a turret-type automatic cutting and winding apparatus. The turret is typical of those used in the industry and involves a turret with a motor, a gear box, and related apparatus that can swing a full roll of film away from the production apparatus and place an empty core into the web feed without disruption of the production of web material.

The industry lacks a centerwinder that receives and rolls a web material without the use of complex apparatus such as a turret and permits continued winding without interruption of the manufacture of the web material. The industry further lacks a turretless centerwinder with an automatic transfer mechanism. Also, the industry lacks a turretless centerwinder with an efficient shaft handling mechanism.

SUMMARY OF THE INVENTION

The invention includes a centerwinder for receiving and winding a web material. A source for a constant feed of the web material provides the web material to the centerwinder. The centerwinder has at least two winding shafts. The two winding shafts are positioned approximately parallel to one another and independently rotate in a stationary structure or frame. The centerwinder has a lay-on arm assembly. The web material passes through the lay-on arm assembly and is wound on one of the winding shafts to a predetermined quantity. The lay-on arm assembly cuts the web material upon obtaining the predetermined quantity of the web material on the winding shaft. The lay-on arm assembly transfers the constant feed of the web material to another of the winding shafts.

The invention include a method for continuously winding a constantly fed web material. The method includes feeding the web material through a lay-on arm assembly to at least one rotating winding shaft. The method includes maintaining a constant pressure of a lay-on roll of the lay-on arm assembly against a roll of the web material as the web material is wound onto the winding shaft. Sensing a predetermined quantity of the web material on the winding shaft then occurs. The method then includes cutting the web material upon obtaining the predetermined quantity of the web material on the winding shaft. Transferring the cut constant feed of the web material occurs by a transfer roll mechanism of the lay-on arm assembly to another of the winding shafts.

DETAILED DESCRIPTION OF THE INVENTION

Figure 1:
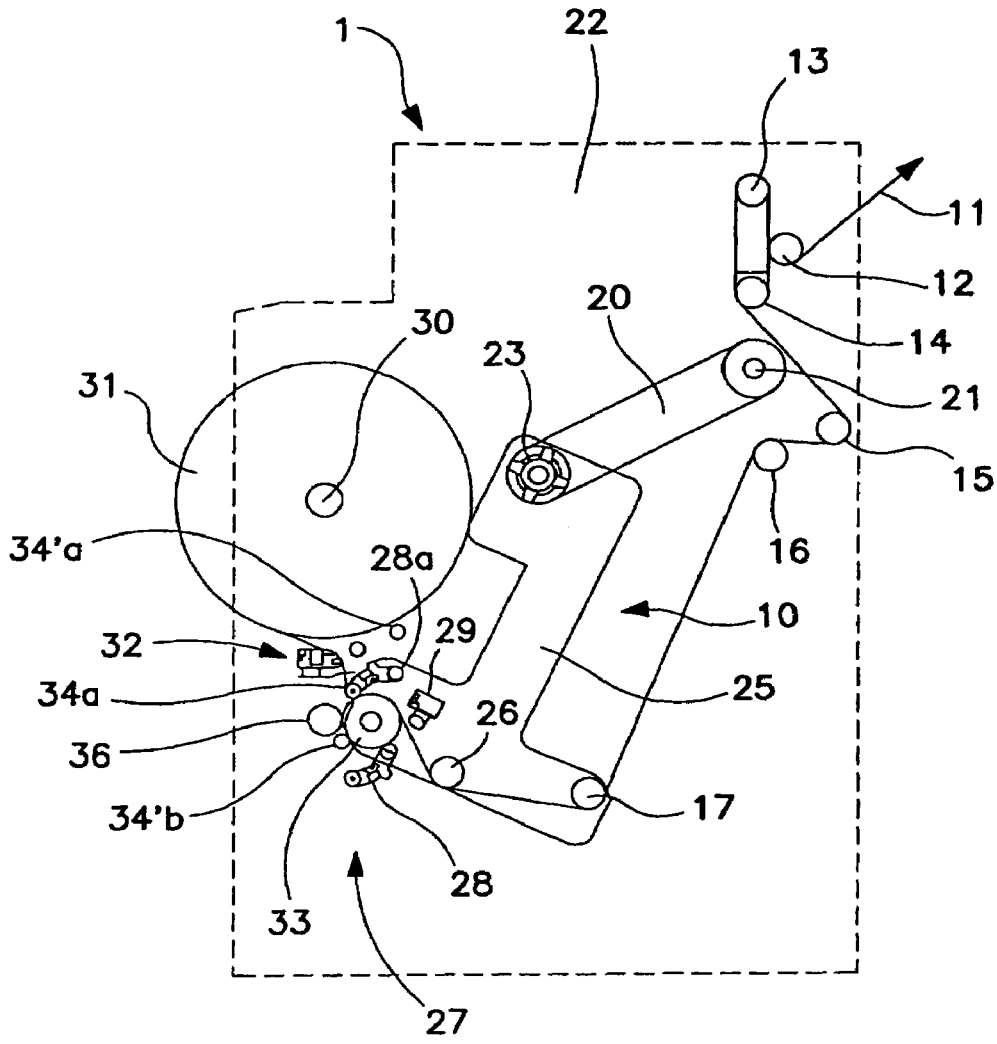
FIG. 1 illustrates a side view of a centerwinder having a lay-on arm assembly of the preferred embodiment.

The invention is a centerwinder for receiving and winding web material sequentially on one of at least two fixed shafts or spindles. The most desirable embodiments of the centerwinder use two shafts in order to enable one shaft to wind web material as the full roll on the second shaft is removed. A lay-on arm assembly of the centerwinder moves from the full roll to the second shaft and directs the leading edge of the cut web material to the empty second shaft. After removal of a full roll, a new core is fitted onto the newly, emptied shaft, and this empty shaft is returned to an operable position within the centerwinder to receive web material. The web material is cut when the first roll is full and a transfer roll on the lay-on arm assembly of the invention directs the continuously produced web material to the new core. The centerwinder of the invention eliminates the powered turret assembly common to automatic web centerwinders.

The two winding shafts or spindles used in the centerwinder of desirable embodiments of the invention can be positioned vertically with respect to one another. This embodiment is the most commercially desirable embodiment. The use of terms such as "upper" and "lower" or the terms "up" and "down" to describe rolls of web material, positions of the lay-on arm assembly, and other elements of the invention refers to this embodiment and is used for convenience in describing the invention. These terms are not intended to limit the invention to a particular structural arrangement in relationship to the base or floor of the centerwinder.

The shafts of the invention are positioned in the centerwinder in an appropriate frame or stationary structure. Other necessary equipment common to winding apparatuses and known in the art can also be mounted in or near the stationary structure. Examples of other equipment include a shaft drive train with motors and linkages, electrical components, controllers, pneumatic equipment such as air cylinders, pumps, and hoses, and other related components.

The centerwinder of the invention includes a "lay-on arm assembly." Desirable embodiments of the lay-on arm assembly and components of the lay-on arm assembly include pivotable, multidirectional features. These pivotable, multidirectional features include positioning means or apparatus to move the lay-on arm assembly between "in and out positions" in relation to a particular shaft as well as "up and down positions." The degree of pivotable, multidirectional movement of the lay-on arm assembly and components of the lay-on arm assembly for a particular embodiment of the invention is often determined by the web material to be used with the centerwinder. For example, blown film can require more pivotable, multidirectional features than a heavier web material.

The positioning means or apparatus can include pneumatically, electrically, and/or mechanically driven devices. The positioning means or apparatus of the preferred embodiment of the invention is pneumatic and includes pivots and air cylinders operated by compressed air to move the lay-on arm assembly and components of the lay-on arm assembly. Alternative embodiments of the positioning means or apparatus can include linear slides, electrical motors, servo drives, and jacks.

The positioning means or apparatus can include linkages, sensors, and controls. Cylinder linkages provide the lay-on roll assembly with a constant or "same force" against a winding roll regardless of whether the winding roll is on an upper shaft or on a lower shaft. Sensors, such as mechanical limit switches, linear counters, and electronic or optical switches, can be used to trigger the various movements of the lay-on arm assembly and the components of the lay-on arm assembly. Controls can include simple mechanical, electrical, or pneumatic controls but are, desirably, commercially available electronic controllers, such as a programmable logic controller or a "PLC."

Transfer rolls are an example of components that can be provided on the lay-on arm assembly. Transfer rolls are known in the art and, when used with the lay-on arm assembly of the invention, are automatically brought into the proper position for a fully automatic transfer of web material from one shaft to another shaft or to assist an operator during a manual cut and transfer of the web material. The transfer rolls of the preferred embodiment of the invention are pivotable and can operate between a plurality of positions. The movement of the transfer rolls is performed and controlled by the positioning means or apparatus and the controls described above.

The lay-on arm assembly of the invention can include a multifunctional component such as a lay-on roll assembly. Automatic transfer of a continuously fed web material is achieved by the preferred lay-on arm assembly equipped with a lay-on roll assembly. The preferred lay-on arm assembly jointly positions and operates the components of a pivotable lay-on roll assembly having a film guide arm, guide rolls, and a knife arm. Desirable lay-on roll assemblies can operate with several core sizes and/or "line speeds." Typical core sizes are from three inches to six inches in internal diameter. Typical "line feeds" of continuously fed web material can be between 150 and 500 feet per minute. The lay-on roll assembly of the invention can automatically transfer a web material regardless of the direction of rotation of a shaft or core.

The centerwinder of the invention can include several machinery configurations. The lay-on roll assembly can be used with equipment wherein manual operations are used to cut the web material and apply the web material to a new core. An automatic embodiment of the invention can both cut and transfer the web material in two directions or with both a clockwise and counterclockwise rotation of the roll of web material. The preferred embodiment of the invention couples the automatic cut and transfer means with an integrated hoist. An integrated hoist swings a full roll of web material from the inside of the winder to a lift table or similar support. The full roll can then be removed from the winding shaft by a puller from inside the core.

The shaft and roll handling means of the preferred embodiment can include a chuck assembly with swinging means for a full or loaded winding shaft or spindle. The swinging means permits the winding shaft or spindle to swing while maintaining support of the loaded shaft or spindle. The shaft puller means of desirable embodiments of the invention is compact and can serve from one position both an upper winding shaft and a lower winding shaft.

FIG. 1 illustrates a side view of a centerwinder having a lay-on arm assembly of the preferred embodiment. A web material 11 such as a blown film polymer enters the centerwinder 1 through a tension apparatus involving a plurality of idler rolls and dancer rolls. A first idler roll 12 receives the web material 11 followed by a "dancer" roll 13 and then additional idler rolls as needed. This embodiment has a plurality of additional idler rolls 14, 15, 16, and 17. A dancer roll 13 floats or is movable such that it maintains a constant tension on the web material 11 as the web material 11 passes through the centerwinder 1.

The centerwinder 1 includes the lay-on arm assembly 10 with apparatus, including linkage means (not shown) and positioning means or apparatus (not shown), to operate and guide the movement of the lay-on arm assembly 10. The lay-on arm assembly 10 has a pivot arm 20 mounted to a bar 21, which is affixed to side frames. Only one side frame 22 is illustrated with phantom lines in this figure. The pivot arm 20 at an end opposite to the bar 21 has a bearing 23 rotatably fixed to a lay-on arm 25.

The lay-on arm 25 of this embodiment has a geometric shape similar to an Arabic numeral "1." This geometric shape permits the lay-on arm 25 to swing from the bearing 23 while holding the various rolls necessary to guide the web material 11 onto a core or first shaft 30 to form roll 31 of web material 11. The web material 11 passes about idler roll 17 and then over or under spreader roll 26. The web material 11 in this embodiment of the invention passes over or under spreader roll 26 depending upon the desired operation as further described below. The web material 11 passes from the spreader roll 26 to the lay-on roll assembly 27. The lay-on roll assembly of desirable embodiments of the invention includes a plurality of components positioned at the base of the lay-on arm 25 nearest to the rolls of web material 11.

The lay-on roll assembly 27 of desirable embodiments of the invention can include additional idler rolls as necessary and a transfer roll mechanism 28*a* and 28*b*. The web material 11 passes through the lay-on roll assembly 27 to the roll 31 of web material 11. This conveyance of the web material 11 through the lay-on roll assembly 27 can be over or under spreader roll 26 past an optional electrostatic bar 29 for removing electrostatic charge from the web material 11. The web material 11 then passes under or over lay-on roll 33 to the roll 31.

FIG. 1 illustrates the lay-on roll assembly 27 of desirable embodiments of the invention immediately after the transfer roll mechanism 28*a* and 28*b* is triggered to permit the web material 11 to be cut and transferred to the lower core or second shaft 36. The knife 32 is therefore shown in a position for cutting the web material 11 from roll 31. The respective transfer rolls 34*a* and 34*b* of the transfer roll mechanism 28*a* and 28*b* are shown when the transfer rolls 34*a* and 34*b* hold the web material 11 in position for cutting and transfer. The positions of the transfer rolls 34'*a* and 34'*b* of the transfer roll mechanism 28*a* and 28*b* are shown in their normal operable position when the web material 11 is being supplied to roll 31. The positioning means or apparatus for the transfer roll mechanism 28*a* and 28*b* and the knife 32 in desirable embodiments of the invention includes compressed air cylinders (not shown).

Figure 2:
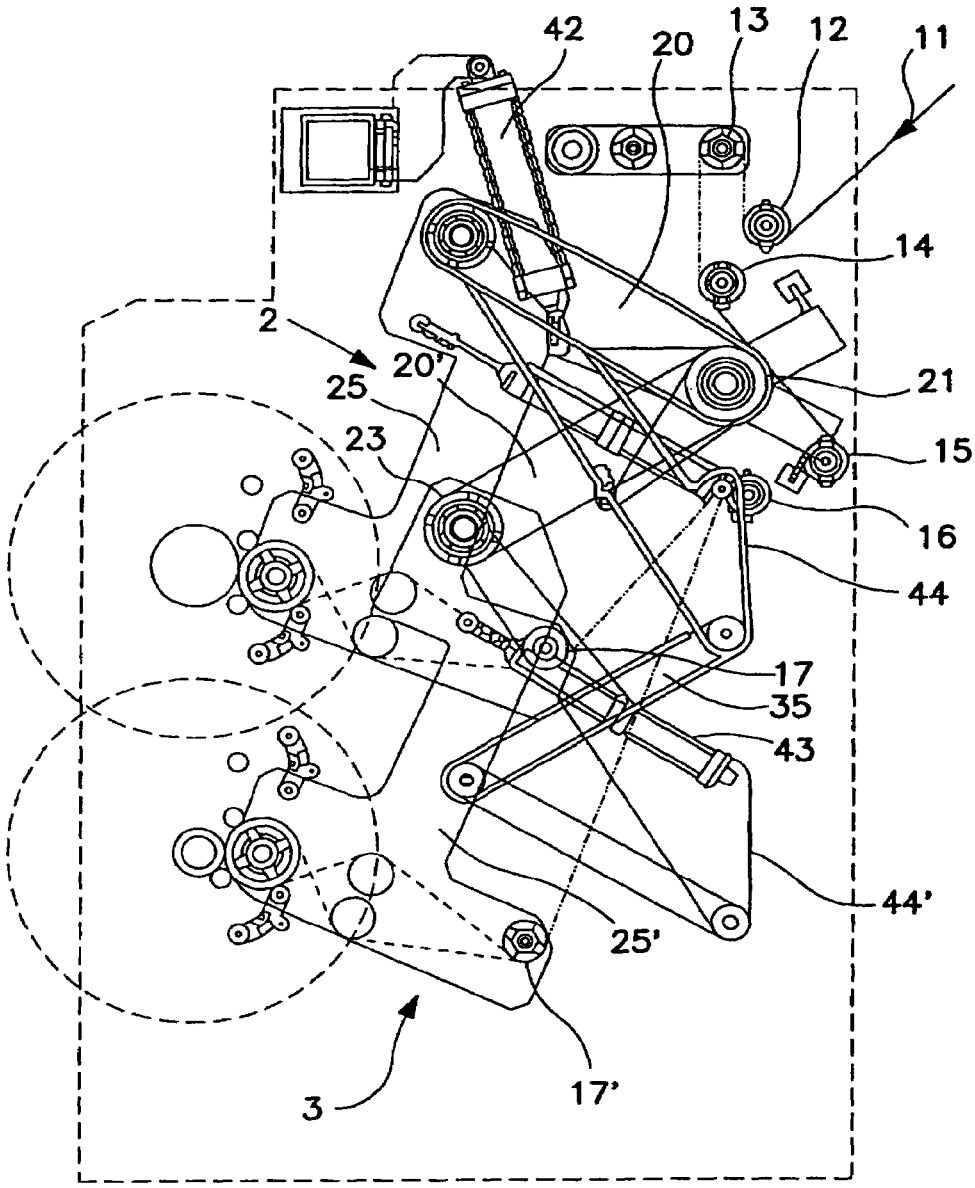
FIG. 2 illustrates a side view of a centerwinder having a lay-on arm assembly of the preferred embodiment of the invention wherein the positions of the same lay-on arm assembly are shown in both an upper position and a lower position.

FIG. 2 illustrates a side view of a centerwinder 1 having a lay-on arm assembly 10 of the preferred embodiment of the invention wherein the positions of the same lay-on arm assembly 10 are superimposed in both an "upper position" 2 and a "lower position" 3. The elements of the lay-on arm assembly in this figure are identified below with the same reference numbers for the upper and lower positions but with a prime symbol or apostrophe appearing on the reference numbers for the same elements in their lower position.

The lay-on arm assembly 10 is moved between its upper position 2 and lower position 3 by at least one vertical air cylinder 42. The pivot arm 20, a lower pivot arm 35, and a linkage belt 44 guide and position the lay-on arm assembly 10. A horizontal air cylinder 43 moves the lay-on arm assembly 10 towards or away from the upper core or first shaft 30 or the lower core or second shaft 36. The supports, air hoses, and related structures, controls, and sensors for the positioning means or apparatus are not shown.

FIGS. 2*a* through 2*d* illustrate the stepwise operation of the centerwinder 1 in the transfer of web material 11 between a first shaft 30 to a second shaft 36. In this embodiment the roll 31 of web material 11 has a clockwise rotation, and the web material 11 passes under the spreader roll 26. These figures also illustrate the positions of the preferred embodiment of the transfer roll mechanism 28*a* and 28*b* in relationship to the knife 32 as these components proceed though an operational cycle of the lay-on arm assembly 10.

Figure 2A:
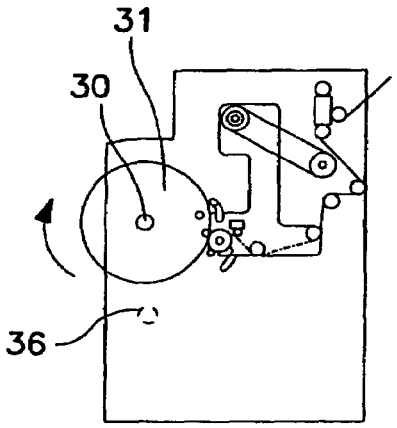
FIGS. 2*a* through 2*d* are side views of the centerwinder and illustrate the operation of the centerwinder in the transfer of web material between a first shaft to a second shaft.

FIG. 2*a* illustrates the lay-on arm assembly 10 as the roll 31 of web material 11 nears its desired volume of web material 11. The desired volume of web material 11 equates to a predetermined radius for the roll 31 of web material 11. The speed of web feed in most systems is constant. Therefore, the motor (not shown) turning the first shaft 30 slows as the radius of the roll 31 increases. The lay-on arm assembly maintains a constant pressure of the lay-on roll 33 against the roll 31 as the lay-on arm assembly 10 moves or lowers in relative position to the increasing diameter of roll 31. When the predetermined radius of the roll 31 of web material 11 is obtained, the lay-on arm assembly 10 is triggered by a sensor and a control means initiates a cutting and web transfer process. The triggered action causes the lay-on arm assembly 10 to drop and extend such that the lay-on roll assembly 27 moves toward the bottom of the roll 31 of web material 11.

Figure 2B:
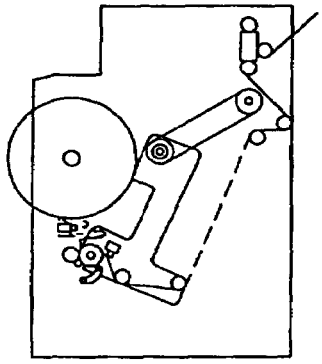

FIG. 2*b* illustrates the lay-on roll assembly 27 at the bottom of full roll 31 of web material 11. After the lay-on roll is positioned against a new core or second shaft 36, the transfer roll mechanism 28*a* is closed thereby "nipping" the film against the lay-on roll 33. The core had previously been prepared with tape or glue. Then the knife 32 pivots into position, and the traversing knife 32 "fires" across or traverses the web as the transfer roll mechanism 28*a* pivots and moves the web material 11 against the knife 32. After the cut, the knife 32 returns to a "park" or rest position, and the transfer roll mechanism 28*a* opens.

Figure 2C:
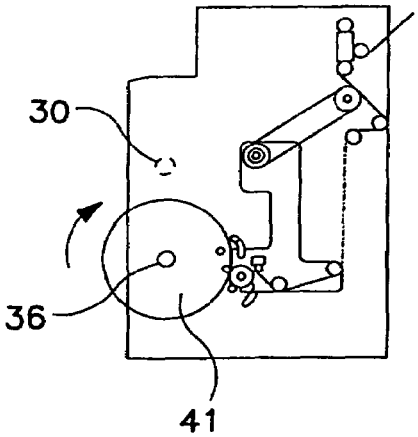

FIG. 2*c* illustrates the lay-on arm assembly 10 at a side of a full roll 41. The lay-on arm assembly 10 begins to rise or move toward the empty first shaft 30 as the radius of web material 11 fills the roll 41. When the roll 41 obtains a predetermined length, the lay-on arm assembly 10 is triggered to cut the web material 11 and transfer the web material 11 to the empty, rotating first shaft 30.

Figure 2D:
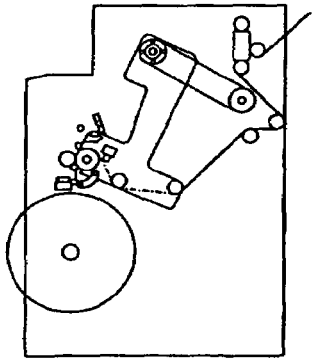

FIG. 2*d* illustrates the lay-on arm assembly 10 once it moved towards the empty first shaft 30. The lay-on arm assembly 10 positions the lay-on roll assembly 27 for cutting and transferring of the web material 11 to the empty first shaft 30. The knife 32 traverses the web material 11 as the transfer roll mechanism 28*b* quickly directs the feed of web material 11 onto the knife 32. The movement of the knife 32 and transfer roll mechanism 28*a* and 28*b* in opposite directions into the web material 11 occurs in a fraction of a second so as not to disrupt the constant feed of the web material 11. The transfer roll mechanism 28*b* then directs the cut web material 11 to the empty core or first shaft 30. As the new core or first shaft 30 winds web material 11, the full roll 41 can be removed from the centerwinder 1 and a new empty core placed onto the empty shaft of the centerwinder 1.

FIGS. 2*a* through 2*d* illustrate an embodiment of the invention wherein the web material 11 is wrapped about the core in a clockwise direction. This same embodiment of the invention can wrap a web material 11 in a counterclockwise direction. When a counterclockwise direction is used, the web material 11 is directed from idler roll 17 over the top of spreader roll 26 through the lay-on roll assembly 27. The web material 11 is fed from the lay-on assembly 27 to a counterclockwise rotating core (not shown).

The use of a clockwise or counterclockwise winding is determined by the type of web material that is produced and the needs of the end user. For example, certain web materials have a coating on one surface to facilitate printing, and such a surface must be on a specific side of a roll to accommodate the equipment of an end user.

Figure 3:
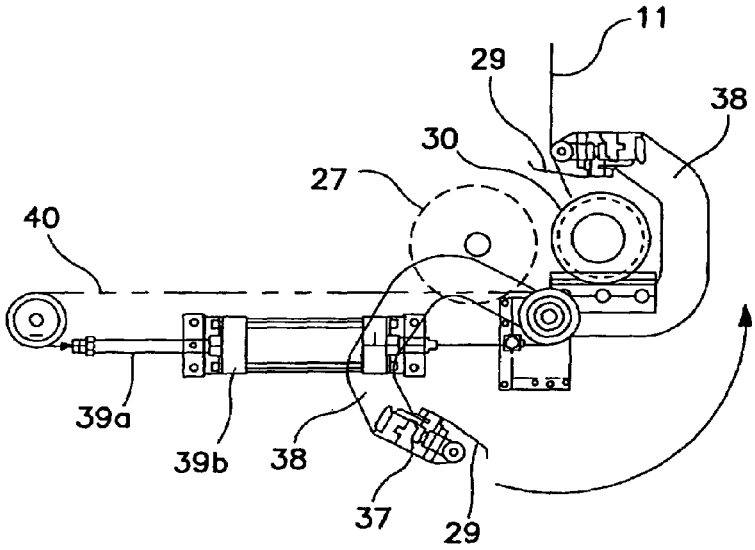
FIG. 3 illustrates a side view of a knife assembly.

FIG. 3 illustrates a side view of a knife assembly positioned on a lower spindle. The knife 32 is mounted to a knife cylinder 37. The knife cylinder 37 is mounted to a knife arm 38. The knife arm is actuated or "fired" from a resting or parked position in a circular motion upward into a cutting or firing position. This figure illustrates the same knife arm 38 in both the lower parked position and the upper firing position. The knife arm 38 is actuated by an assembly having a rod 39*a* and cylinder 39*b* attached to a chain 40. An electronic control means (not shown) and a transferring means or apparatus (not shown) can be used with this structure to position the knife arm 38.

Figure 4:
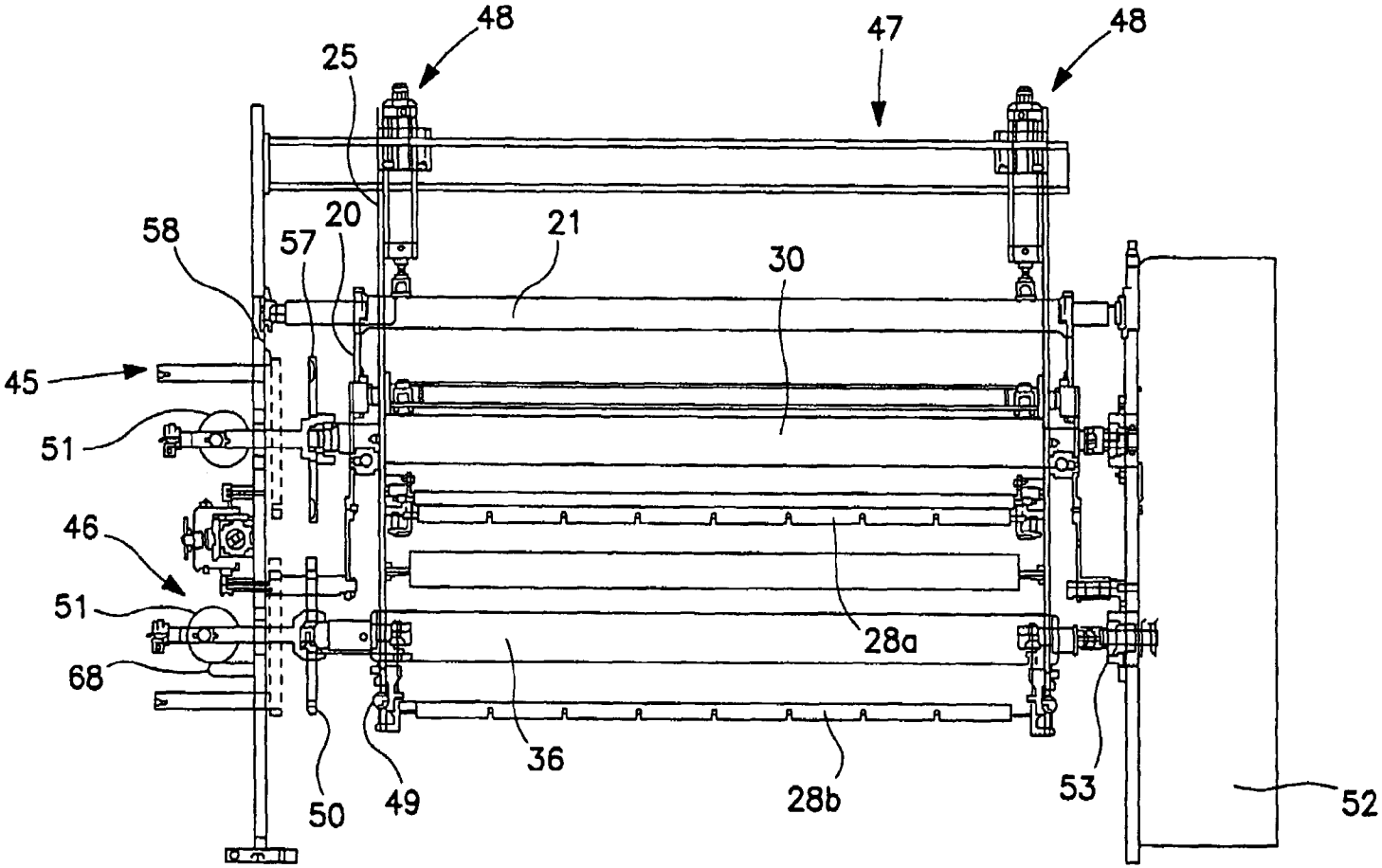
FIG. 4 illustrates a front view of a centerwinder 1 having two shafts.

FIG. 4 illustrates a front view of the preferred embodiment of the centerwinder 1 having two shafts 30 and 36 with certain details removed for clarity. Each shaft is mounted on one side to a shaft pivoting means 45 for the first shaft 30 and a shaft pivoting means 46 for the second shaft 36. Each of the shaft pivoting means includes a chuck 50 and spherical support 51. Pivotal movement of either of the shafts 30 and 36 is desirably achieved by a swing hoist 47 and desirably two hoists 48. The clockwise or counterclockwise rotation of the first shaft 30 and the second shaft 36 is performed through a linkage means, including belts, chains, or gears (not shown), a motor (not shown), and appropriate control devices in cabinet 52.

Each chuck 50 retracts from a locked position 57 to an open position 58. When the chuck 50 (shown with phantom lines) is retracted to the open position 58, the shaft retracts and disengages from its drive chuck 53. The swing hoist 47 holds the horizontal position of either the first shaft 30 or the second shaft 36 and permits the shaft to pivot in the horizontal plane from the spherical support 51. Desirably, the shaft pivots approximately 90 degrees from inside the centerwinder 1 to a position where a full roll of the web material 11 can be removed from the shaft and a new core placed on the shaft. The shaft with an empty core can then be pivoted back into the centerwinder 1, and the chuck 50 can be moved into its locked position 57 so as to engage the shaft.

Figure 5:
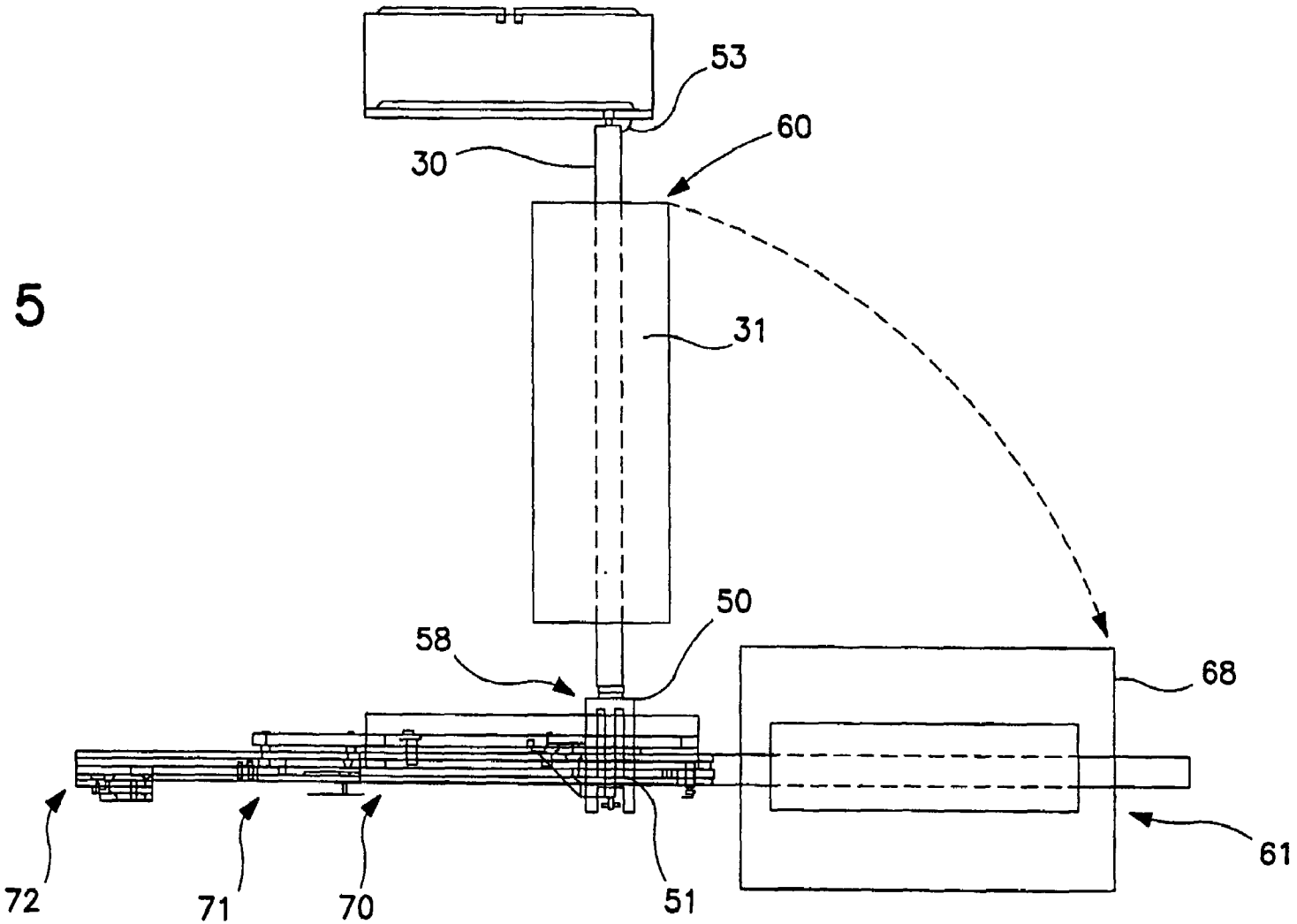
FIG. 5 illustrates a top plan view of a centerwinder having the optional means for pivoting a shaft with a core into the centerwinder.

FIG. 5 illustrates a top plan view of a centerwinder 1 having the optional shaft pivoting means for rotating a shaft between an operable position in the centerwinder 1 and a position for removal of a roll of web material 11. This figure shows a single first shaft 30 with a full roll 31 of web material 11 in two positions or conditions. The first position is the winding position 60, wherein the shaft rotates to form a roll of web material 11. The second position is the unloading position 61, where a full roll can be removed from the shaft and a new core inserted onto the shaft. Other elements of the invention have been removed from this figure for clarity.

FIG. 5 shows a full roll 31 of web material 11 formed on a core (not shown) supported by a first shaft 30. The first shaft 30 is supported by the swing hoist 47 (not shown in this figure). The chuck 50 is retracted to the open position 58 such that the other end of the shaft 30 disengages from the drive chuck 53. The swing hoist 47 pivots the shaft 30 with the full roll 31 about the spherical support 51. The shaft 30 with the full roll 31 is moved to the unloading position 61. Desirable embodiments of the invention include a mechanical lift table 68 for supporting a full roll 31 of web material 11. The invention permits one or more other cores on the centerwinder 1 to receive and wind web material 11 during the unloading of a full roll.

FIG. 5 also illustrates an optional shaft puller 70 for use with the invention or similar devices. The shaft puller 70 can be a pneumatic, hydraulic, or other mechanical device for withdrawing a shaft 30 from a core holding a full roll of web material. A full roll is desirably rested on a lift table 68, and the shaft puller 70 is actuated to retract the shaft 30 from the core.

Desirable embodiments of the invention combine a pneumatic means for engaging a shaft to a core and firmly holding the core to the shaft. Such a pneumatic means permits the rotation of the shaft simultaneously to rotate the core as web material is fed to the core. When a full roll is to be removed from the shaft, the pneumatic means is released and disengages the shaft from the interior diameter of the core. The shaft can then be withdrawn manually or by the shaft puller 70.

When the full roll is removed, a new core can be positioned over the lift table 68 and the shaft inserted into the core. The pneumatic means or other apparatus is then activated to engage the core to the shaft.

Figure 6:
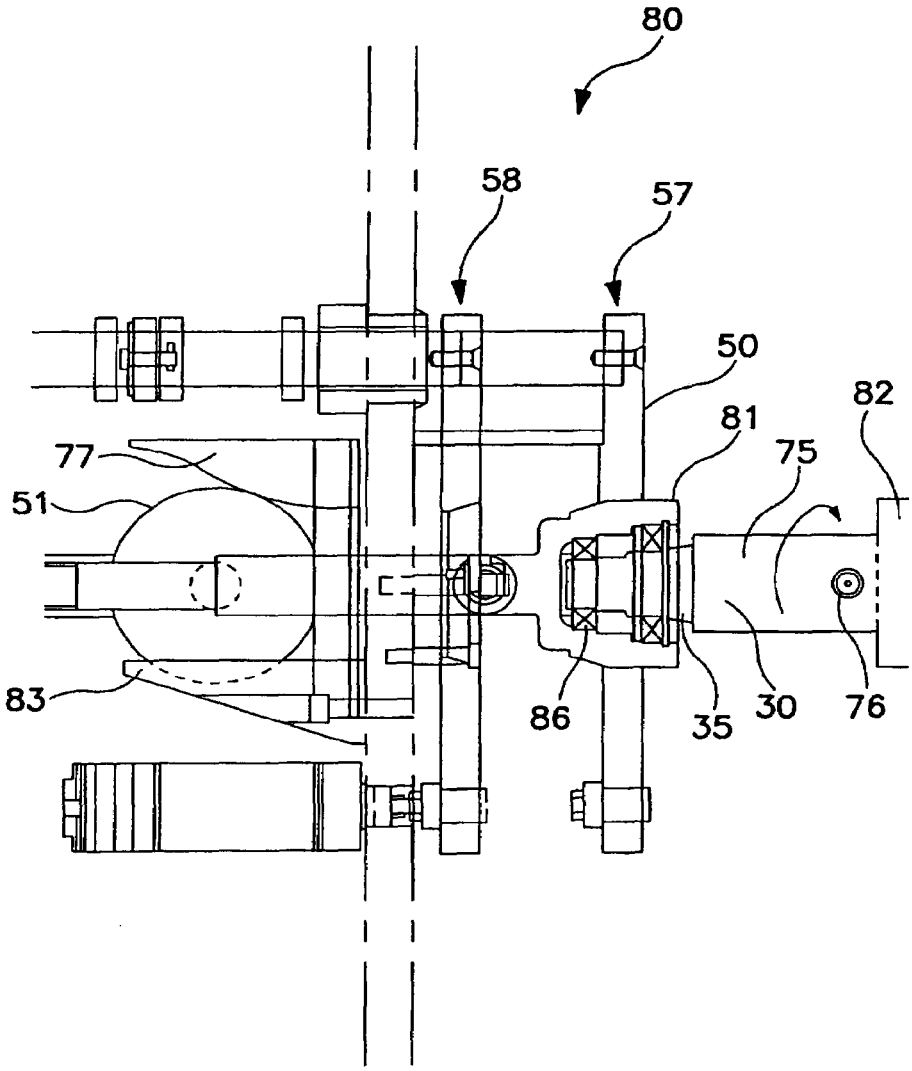
FIG. 6 illustrates a front view of the chuck assembly of FIG. 4.

FIG. 6 illustrates a front view of the chuck assembly 80 on the nondriven side or the shaft pivoting means 45 and 46 of FIG. 4. The chuck 50 is illustrated in both its open position 58 and locked position 57 (shown with phantom lines). The chuck closes on airshaft seal 81. Desirable embodiments of the invention support the winding shaft or in this figure the first shaft 30 by a tapered shape to facilitate alignment. The airshaft 75 is supported by bearings 86. The airshaft 75 includes an air inflation port 76. This figure also includes a cardboard core 82. The airshaft seal 81 retracts and extends into the spherical support 51 respectively with the movement of the chuck 50 from the open position 58 to the locked position 57. The spherical support 51 pivots on a support plate 83. When the chuck 50 is retracted, a shaft lowers slightly, and the weight is supported by spherical support 51. A wedge 77 is provided to pull a shaft out of its drive chuck.

Figure 7:
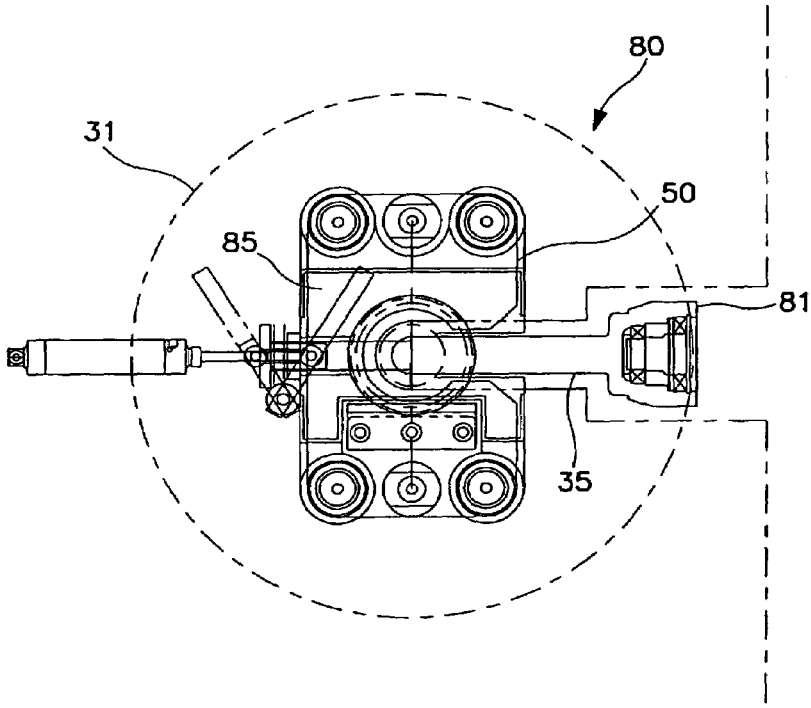
FIG. 7 illustrates a side view of the chuck assembly.

FIG. 7 illustrates a side view of the chuck assembly 80. The chuck 50 has an opening to receive and hold the shaft 30 when the shaft 30 is in the winding position 60. The plate 85 of the chuck 50 holds the airshaft seal 81.

Figure 8:
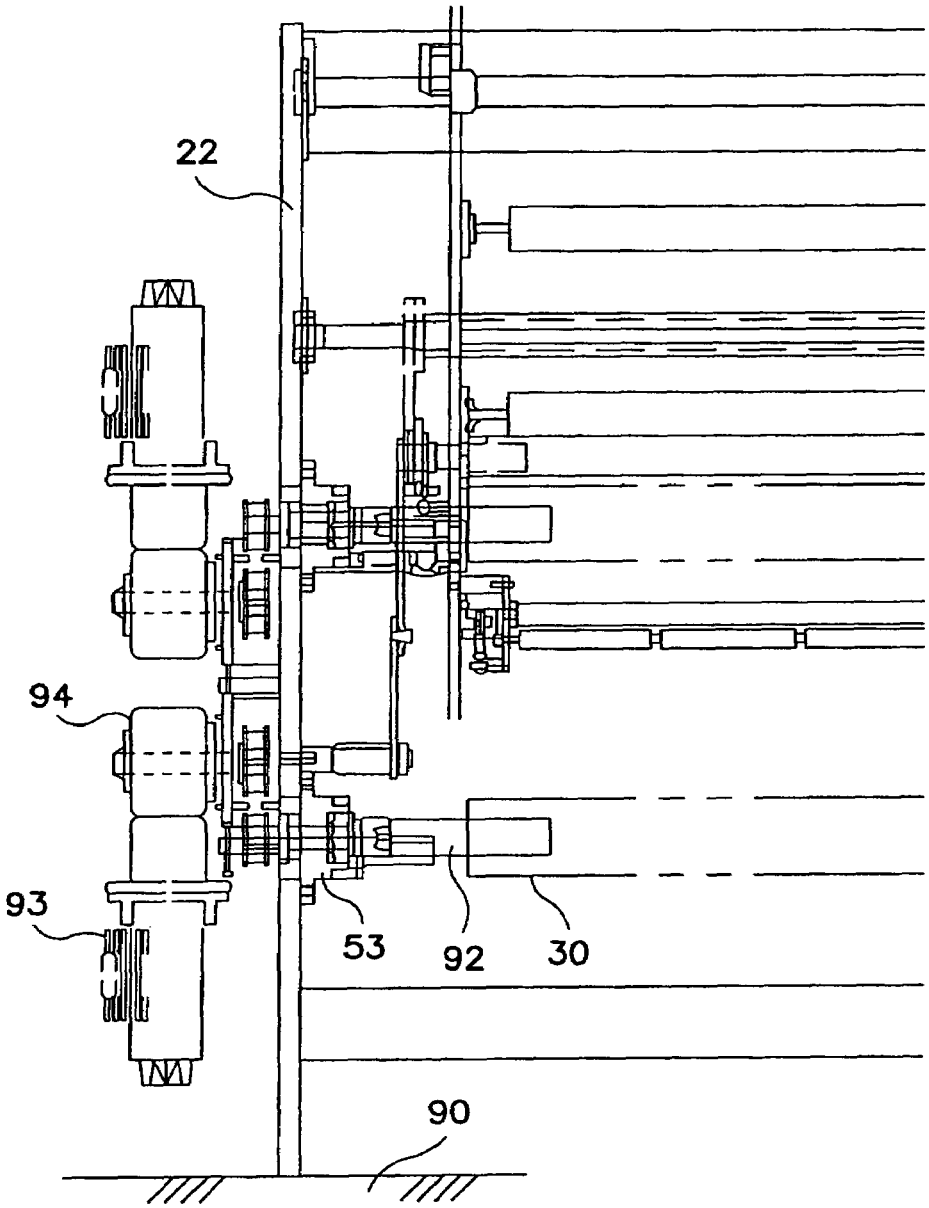
FIG. 8 illustrates a back view of the drive side of the centerwinder.
Figure 9:
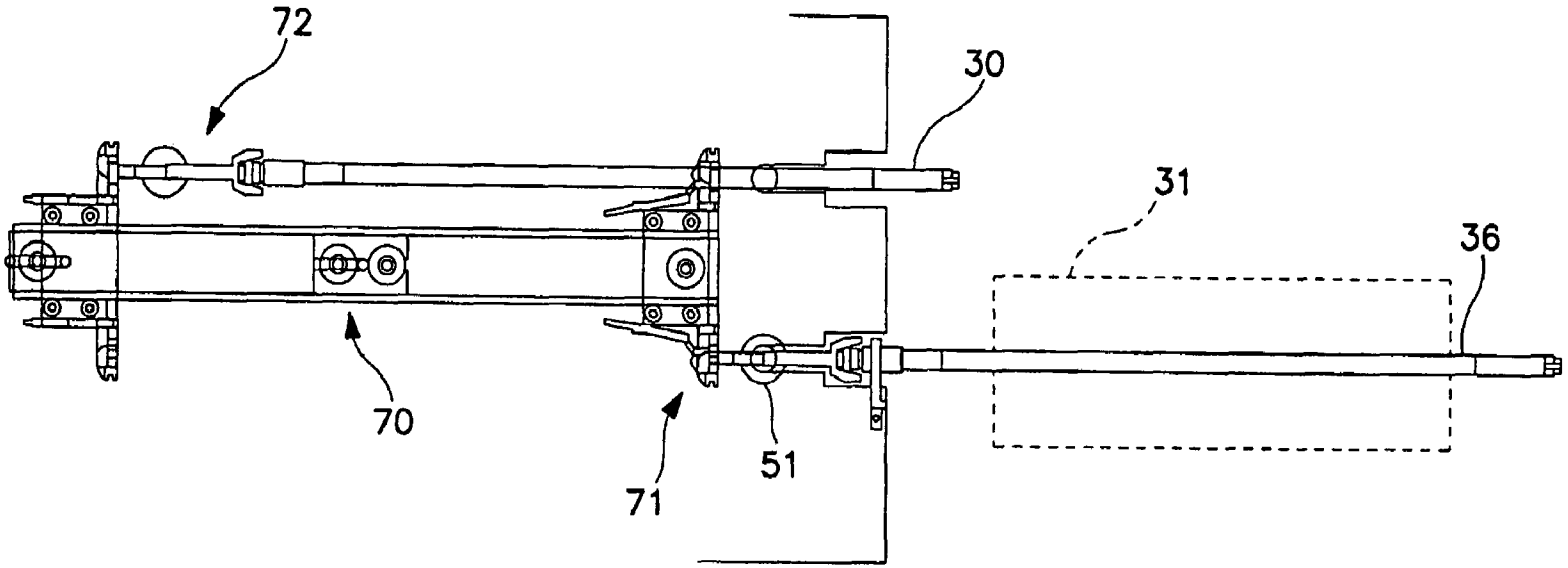
FIG. 9 illustrates a side view of the shaft puller.

FIG. 8 illustrates a back view of the drive side of the chuck assembly 80 resting on the floor 90 with the cabinet 52 S removed. A spindle or drive chuck 53 is fixed to a side frame 22 of the centerwinder 1. An airshaft 92.is removably affixed to the inside of the first shaft 30 and the second shaft 36. A motor 93 drives the drive chuck 53 through a reduction gear 94. 10 FIG. 9 illustrates a top plan view of the shaft puller 70. The shaft puller 70 is illustrated in both its start position 71 and its retracted position 72 superimposed on one another.

We claim:

1. A centerwinder for receiving and winding a constantly fed web material comprising:

at least two winding shafts, said at least two winding shafts are positioned approximately parallel to one another and independently rotate in the same direction in a stationary structure;

a lay-on arm assembly, said web material passes through said lay-on arm assembly and is wound on one of said winding shafts to a predetermined quantity, said lay-on arm assembly:

(i) cuts said web material upon obtaining said predetermined quantity of said web material on said winding shaft; and (ii) transfers said cut constant feed of said web material to another of said winding shafts;

a positioning apparatus and a control means for said lay-on arm assembly, said positioning apparatus and said control means maintain a constant pressure of a lay-on roll of said lay-on arm assembly against a roll of said web material as said web material is wound onto said winding shaft; a pivot means for each of said winding shafts, said pivot means enables each of said winding shafts to swing from a winding position in said centerwinder to position for removing cut web material from said winding shaft; and a spherical support for each of said winding shafts, each said winding shaft pivots on said spherical support.

2. The centerwinder of claim 1 wherein said positioning apparatus and said control means for said lay-on arm assembly moves said lay-on arm assembly from said winding shaft having said predetermined quantity of said web material to an empty winding shaft.

3. A centerwinder for receiving and winding a constantly fed web material comprising:

a first winding shaft and a second winding shaft, said first winding shaft and said second winding shaft are positioned approximately parallel to one another and independently rotate in the same direction in a stationary structure;

a lay-on arm assembly, said web material passes through said lay-on arm assembly and is wound into a roll on said first winding shaft to a predetermined quantity, said lay-on arm assembly:

(i) maintains a constant pressure of a lay-on roll against said roll of said web material as said web material is wound onto said winding shaft;

(ii) cuts said web material upon obtaining said predetermined quantity of said web material on said first winding shaft; and (iii) transfers said cut constant feed of said web material to said second winding shaft;

a positioning apparatus and a control means for said lay-on arm assembly, said positioning apparatus and said control means operates a knife and a transfer roll mechanism, to cut said web material and to transfer a leading edge of said cut web material to said second winding shaft; and two spherical supports, each of said two spherical supports affixed to one end of each of said first winding and said second winding shaft, said first winding shaft and said second winding shaft both independently pivot on their respective one of said spherical supports.

4. The centerwinder of claim 3 further comprising:

a shaft puller, said shaft puller independently removes said first winding shaft and said second winding shaft from said roll of said web material and reinserts said removed first winding shaft and second winding shaft into an empty core for receiving web material.

5. A centerwiding for receiving a constantly fed web material comprising:

at least two winding shafts, said at least two winding shafts are positioned approximately parallel to one another and independently rotate in the same direction in a stationary structure;

a lay-on arm assembly, said web material passes through said lay-on arm assembly and is wound on one of said winding shafts to a predetermined quantity, said lay-on arm assembly;

(i) cuts said web material upon obtaining said predetermined quantity of said web material on said winding shaft; and (ii) transfers said cut constant feed of said web material to another of said winding shafts;

a positioning apparatus and a control means for said lay-on assembly, said positioning apparatus and said control means maintain a constant pressure of a lay-on roll of said lay-on assembly against a roll of said web material as said web material is wound onto said winding shaft; a pivot means for each of said winding shafts, said pivot means enables each of said winding shafts to swing from a winding position in said centerwinder to position for removing said cut web material from said winding shaft; and a shaft puller, said shaft puller removes each of said winding shafts from said roll of said web material and inserts each of said removed winding shafts into an empty core for receiving web material.

6. The centerwinder of claim 5 wherein said positioning apparatus and said control means for said lay-on arm assembly moves said lay-on assembly from said winding shaft having said predetermined quantity of said web material to an empty winding shaft.

* * * * *